US007431419B2

(12) United States Patent
Turner et al.

(10) Patent No.: US 7,431,419 B2
(45) Date of Patent: Oct. 7, 2008

(54) METHOD FOR FREE SPRAYING OF THE NOZZLES OF AN INKJET PRINT HEAD

(75) Inventors: Olaf Turner, Berlin (DE); Uwe Hübler, Neuenhagen (DE); Axel Kieser, Berlin (DE)

(73) Assignee: Francotyp-Postalia GmbH (DE)

( * ) Notice: Subject to any disclaimer, the term of this patent is extended or adjusted under 35 U.S.C. 154(b) by 0 days.

(21) Appl. No.: 11/738,720

(22) Filed: Apr. 23, 2007

(65) Prior Publication Data

US 2007/0268323 A1 Nov. 22, 2007

(30) Foreign Application Priority Data

May 19, 2006 (DE) ..... 10 2006 023 540

(51) Int. Cl.
*B41J 29/393* (2006.01)

(52) U.S. Cl. ..... 347/19; 347/30

(58) Field of Classification Search ..... 347/9, 347/12, 13, 42, 19, 30, 33–35
See application file for complete search history.

(56) References Cited

U.S. PATENT DOCUMENTS

| | | | | |
|---|---|---|---|---|
| 5,806,994 | A | 9/1998 | Coffy et al. | |
| 6,045,206 | A | 4/2000 | Igval | |
| 6,367,911 | B1 | 4/2002 | Windel et al. | |
| 6,390,577 | B1 | 5/2002 | Fajour | |
| 6,550,888 | B2 * | 4/2003 | Iwata et al. | 347/23 |
| 6,854,826 | B2 * | 2/2005 | Kanda et al. | 347/29 |
| 6,959,973 | B2 * | 11/2005 | Kubota | 347/13 |
| 7,029,095 | B2 | 4/2006 | Tsuboi et al. | |
| 2003/0081045 | A1 | 5/2003 | Shimizu et al. | |
| 2007/0097173 | A1 | 5/2007 | Hubler er al. | |

FOREIGN PATENT DOCUMENTS

| | | |
|---|---|---|
| EP | 0 704 307 | 4/1996 |

* cited by examiner

*Primary Examiner*—Lamson D. Nguyen
(74) *Attorney, Agent, or Firm*—Schiff Hardin LLP

(57) ABSTRACT

In a method for free spraying of the nozzles of an inkjet print head, in particular in a franking and/or addressing machine, in which the print media are directed past a stationary inkjet, at least the nozzles that are not participating in the generation of the current information-conveying print image are freely sprayed onto the current print medium in a mode that is irrelevant for the print image evaluation, while retaining the print position for the inkjet print head. The image-irrelevant mode can be free spraying in a region that is irrelevant for the print image evaluation or in a print pattern that cannot be evaluated. The size and/or number of the dots per pixel is thereby significantly smaller than for an evaluatable pixel. It is thereby ensured that each nozzle is activated at least once during the print image generation. Time is saved and the letter travel is optimized by the retention of the print position.

9 Claims, 4 Drawing Sheets

METHOD FOR FREE SPRAYING OF THE NOZZLES OF AN INKJET PRINT HEAD

BACKGROUND OF THE INVENTION

1. Field of the Invention

The present invention concerns a method for free spraying of the nozzles of an inkjet print head (spraying the nozzles of an inkjet print head to clear those nozzles of clogging), in particular in a franking and/or addressing machine.

2. Description of the Prior Art

It is worthwhile to use the advantages of ink printing in the field of machine franking and/or addressing Printing in such devices ensues without contact by means of an inkjet print head (see, for example, DE 44 24 771C1 and EP 0 696 509 B1). Ink printing technology has the disadvantage, however, that often more ink is consumed for the cleaning of the inkjet print head than for the printing process. That is particularly serious in the case of individualized printing (as opposed to continuous printing.

A franking machine with an inkjet print head is known (see EP 0 696 509 B1 and U.S. Pat. No. 5,806,994) in which the letters are transported lying horizontally and the nozzle surface is arranged parallel to the moving letters. In this machine the nozzles that are used less frequently or not at all are freely sprayed upon printing, as long as no letter is present in front of the print head. For this purpose the letter transport device is provided with corresponding recesses, and a capture reservoir for the freely sprayed ink is arranged below these recesses. The ink consumption is reduced in this manner relative to the priming, but the horizontal letter transport and corresponding design measures are a requirement for achieving this result.

As used herein, "free spraying" means a one-time or repeated activation of one or more nozzles. In contrast to this, "priming" means a multiple, successive free spraying of all nozzles Free spraying is consequently the ink-saving form of the cleaning of the nozzles of an inkjet print head.

An ink printer with a variable cleaning algorithm is known (see EP 0 934 828 A2) in which past franking imprints are recorded and evaluated (historical log) and from log this cleaning regime (schedules) is derived. Information about maximum downtime, weekly letter arrival as well as number and type of the processing workflows per week are recorded in the historical log. The type of the imprints and thus the actual activation of the individual nozzles are not taken into account.

A device for cleaning an inkjet print head in a franking and/or addressing machine is known (see DE 10 2005 052 150.9-27) in which the inkjet print head is stationary, but can be pivoted behind a guide plate in a print window. During a cleaning procedure, the device seals the printhead orifices from the environment. By means of a transport device the print medium is caused to rest against the guide plate (tilted beyond the vertical) and is transported standing on an edge Like the inkjet print head behind the guide plate, the cleaning and sealing device is arranged such that it can be displaced onto and away from the same guide plate. By means of associated displacement mechanism, the inkjet print head is alternatively pivotable into a printing position or into various cleaning regions as well as into a sealing position.

In the printing position the nozzle surface of the inkjet print head is arranged parallel to the guide plate and thus also parallel to the print medium.

In a first cleaning region, the inkjet print head is pivoted out from the printing position to an extent so that at a separation exists that is at least double the normal separation from the print medium, but all ink jets still reach the print medium. Use is made of the fact that, at the provided double separation, the inkjet printing drops disintegrate into smaller satellite drops, whose scatter region is so large that a recognizable print pattern is no longer present.

Given higher transport speeds for the print medium, this method can be applied only in a limited manner due to the mass inertia of the inkjet print head that must be pivoted. The speed of the rotation movement is also limited in order to avoid an unwanted flinging of ink due to the pivoting.

SUMMARY OF THE INVENTION

An object of the invention is to improve the print quality and extend the lifespan of an inkjet print device as well as to provide an optimally high letter throughput in a franking or addressing device that uses an inkjet printhead.

More specifically, an object of the invention is to provide a method for free spraying of the nozzles of an inkjet print head in a franking and/or addressing machine in which the transport speed of the print medium is not limited, and which is suitable both for horizontally-situated print medium transport and transport of print media standing on an edge.

The invention is based on the observation that, in countries with large amounts of incoming mail, it has now become typical to provide postal shipments (in particular letters) with machine-readable, coded, specialized print images (indicia imprint including cliché) to avoid postage losses as well as for security reasons.

This occurs in the form of one-dimensional barcodes or, more recently in the form of two-dimensional barcodes (see, for example, DE 20 2005 000 255 U1).

The individual image points (pixels) of a print image that are evaluated are represented by a number of print points (dots).

A print point arises by a one-time activation of a nozzle. Given a pixel size with 0.5 mm edge length, around 600 dots would represent at one pixel, given a printing density of 200 dpi (dots per inch).

According to the invention at least the nozzles that are not participating in the generation of the respective print image on the current print medium are free-sprayed in a mode that is irrelevant for the print image generation, while retaining the print position of the inkjet print head. This means a significantly fewer number of dots are applied onto the print medium with the aforementioned nozzle than are required for a pixel. The dots can be inserted into what are known as the white and black pixels and superimposed on the dark pixels, or can be arranged otherwise without adulterating the information content. The current print image job is evaluated and then supplemented to produce a resulting print image job, to determine the nozzles to be free-sprayed.

A preferred variant is to spray the nozzles free in an irrelevant region of the image. This ensues by the nozzles that are not used or that are infrequently used being activated at least once simultaneously before or after the relevant print image.

When only the nozzles that are not used or that are infrequently used are sprayed free, ink is optimally saved. Time is saved and the letter throughput is optimized by the retention of the printing position.

DESCRIPTION OF THE PREFERRED EMBODIMENTS

For simplification and for an easier understanding, the representations below are in somewhat schematic form.

A complete indicia imprint for test purposes according to imprint (a) in FIG. 1 includes FIG. 1, in chronological order beginning at the right, the conventional franking imprint, the franking imprint in the two-dimensional barcode, an advertising cliché and other supplementary services such as a one-dimensional address barcode arranged below said advertising cliché.

Figure 1:
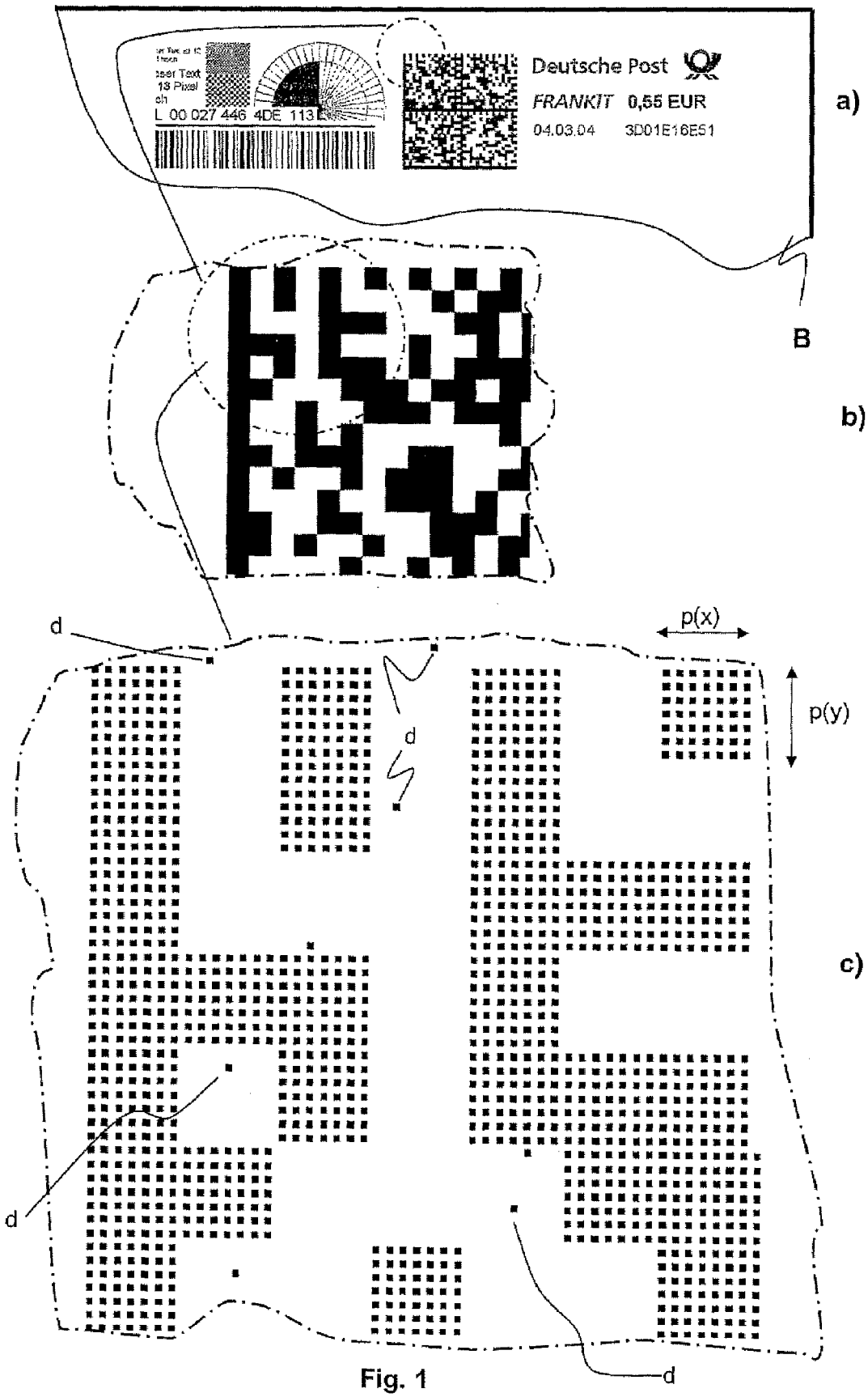
FIG. 1 shows an exemplary indicia imprint with enlarged details for explaining the invention wherein, imprint (a) is a complete indicia imprint with two-dimensional barcode, advertising cliché and other supplementary services such as one-dimensional address barcode, enlargement (b) is a detail from the two-dimensional barcode from imprint (a), and enlargement (c) is a detail from enlargement (b).

A sub-region of the franking imprint in the two-dimensional barcode is shown enlargement (b) of FIG. 1. Here it can already be easily seen how the pixels p are composed of multiple dots d.

The region according to enlargement (b) FIG. 1*b* is shown so enlarged in enlargement (c) that the dimensions of one pixel can be easily seen in x- and y-coordinates, and it can also be seen that individual dots d of the free spray image that lie within the white pixels of the relevant print image Dr. It is clear that these dots inevitably are not considered by an evaluation system that makes the evaluation at a level comparable to the pixel size.

Figure 2:
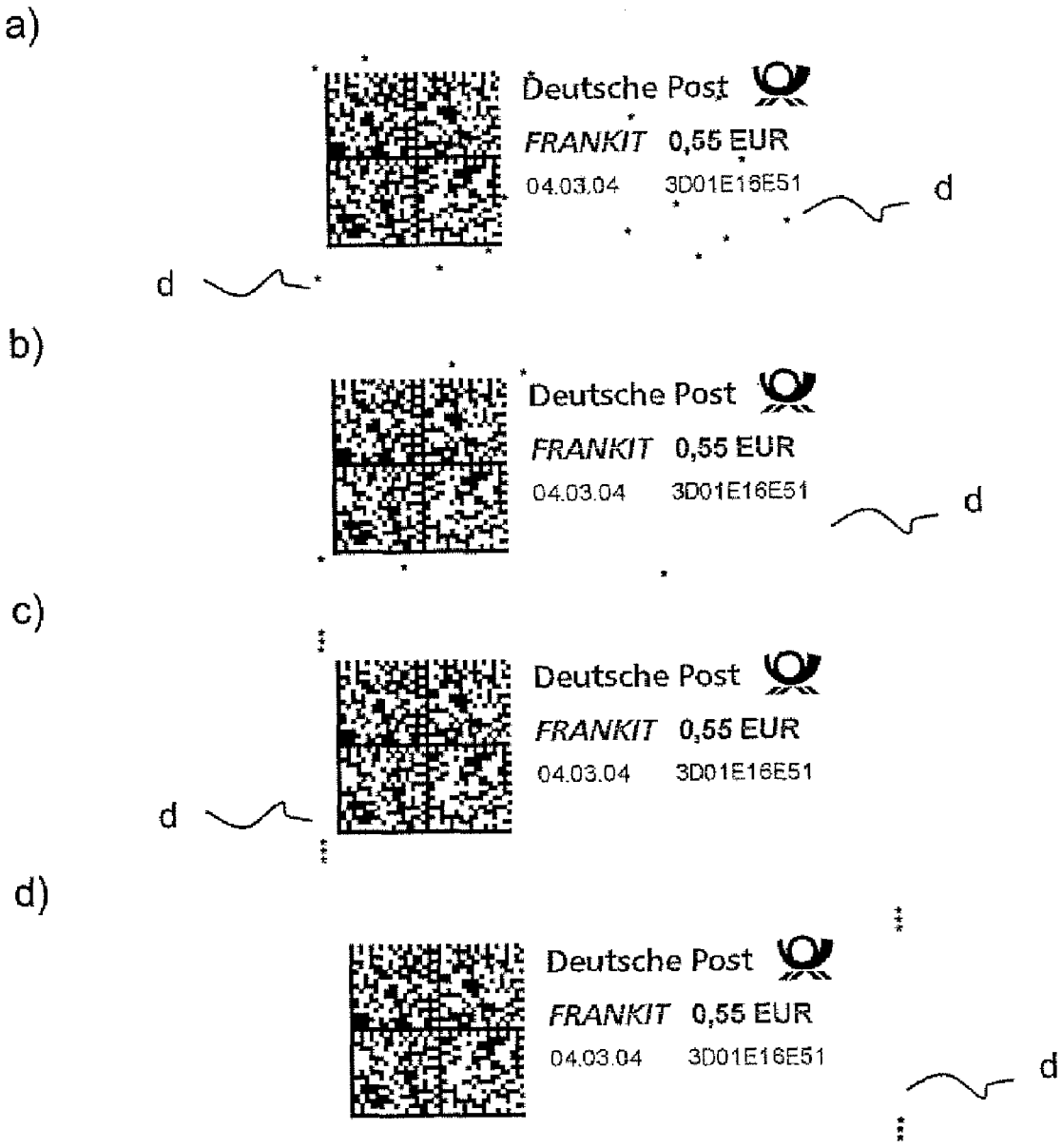
FIG. 2 provides an overview of possible image-irrelevant print modes for the free spray dots in accordance with the invention wherein, imprint (a) shows a distribution of the free spray dots over the print medium, imprint (b) shows a distribution of the free spray dots at sub-regions pertaining to unused or infrequently used nozzles, imprint (c) shows a distribution of the free spray dots in bar form for sub-regions according to the two-dimensional barcode by simultaneous free spraying of unused nozzles, and imprint (d) shows a distribution of the free spray dots in bar form for sub-regions before the indicia imprint by simultaneous free spraying of unused nozzles.

Imprint (b) In FIG. 2 shows the free spray dots distributed in regions in which the nozzles are barely activated or are not activated at all for generation of the information-conveying print image Dr. This in particular applies to the upper and lower margins of the maximum print region.

Imprint (c) in FIG. 2 shows the free spray dots arranged in sub-regions after (in the sense of printing occurring first at the right edge of the imprint) the two-dimensional barcode such that two perpendicular print lines exist in parallel with one another. The nozzles to be sprayed free are all simultaneously activated. In this case it is assumed that all nozzles provided for the barcode region are activated. This variant has the same effect as that according to imprint (b) of FIG. 2 and consequently is equally advantageous.

Imprint (d) in FIG. 2 shows the free spray dots d arranged in bar form in sub-regions before the indicia imprint. Otherwise the relationship is analogous to that in imprint (c) of FIG. 2. In both cases a repeated free spraying is allowable.

Figure 3:
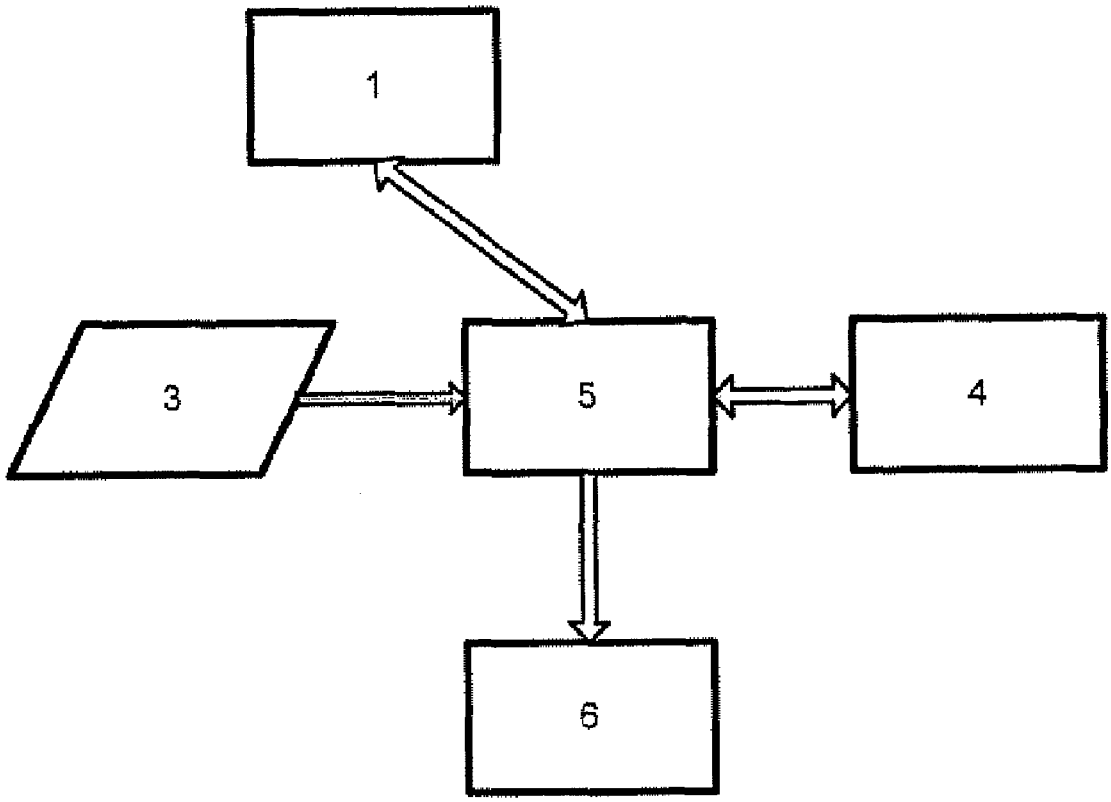
FIG. 3 is a block diagram for the printer control in accordance with the invention.

A block diagram of the printer control is shown in FIG. 3. The perimeter control includes a memory 1 for the relevant (information-conveying) print image Dr. The relevant print image Dr contains information concerning postage, mailing date, franking machine, advertising cliché as well as supplementary letter services such as express mail or bulk mail. This information is determined by upstream devices such as letter scales and dimension scanning components as well as sender requests.

The memory 1 is connected in a bi-directional manner with a microprocessor 5. Moreover, the franking data input 3 is connected to the microprocessor 5 such that it arrives in a unidirectional manner at the microprocessor 5. The data supplied by the franking data input 3 are further processed in the microprocessor 5 into the current print image job and are buffered in the memory 1. In the microprocessor 5 an additional image-irrelevant (non-information conveying) print image job is derived from the current relevant print image job.

Furthermore, a memory 4 in which the resulting print image job for the relevant and image-irrelevant print images Dr, Db is buffered is connected in a bidirectional manner with the microprocessor 5.

The microprocessor 5 is connected in a unidirectional manner with a printing device 6 that receives the activation data As for the current resulting print image D from said microprocessor 5 and prints out the print image D.

Figure 4:
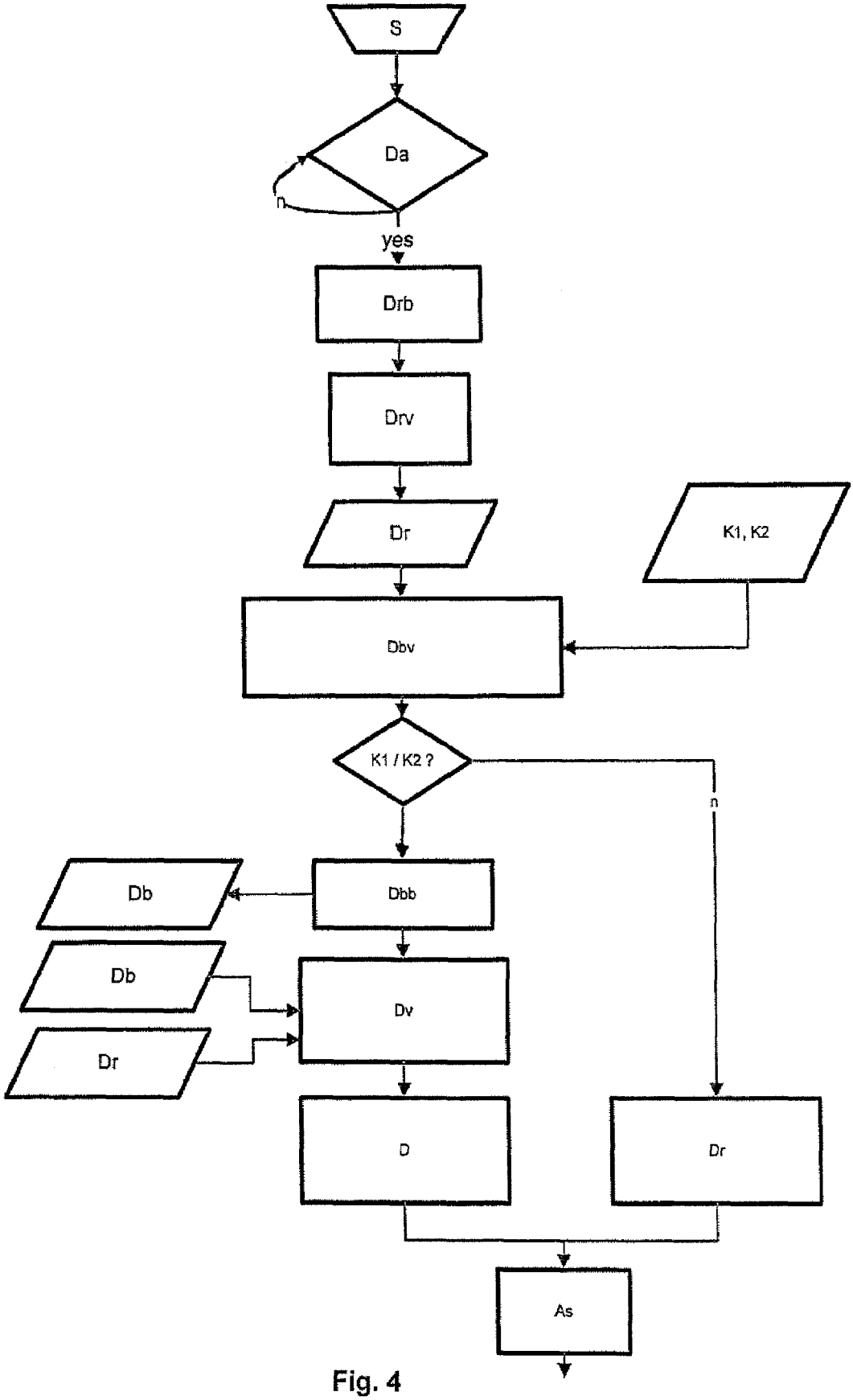
FIG. 4 is a flowchart for the block diagram according to FIG. 3.

The associated flow diagram regarding the block diagram according to FIG. 3 is shown in FIG. 4. With the intake of a print medium B into the franking machine, the leading edge of the print medium B passes a sensor and therewith initiates the start S for the print job Da. The franking print calculation Drb and subsequently the franking print preparation Drv ensue by means of the postage-relevant information and the information regarding the desired advertising cliché from the franking data input 3. The data acquired for the relevant print image Dr acquired with this are buffered. The information of which nozzles are activated to which extent simultaneously accumulates in the franking print preparation Drv. This information is compared with criteria K1 input in the microprocessor for unused nozzles and criteria K2 for rarely-used nozzles and an image-irrelevant print image Dbv is initially prepared from these. For this purpose an image-irrelevant print image Dbb is subsequently calculated and stored as a current image-irrelevant print image Db. The data for the relevant print image Dr and the image-irrelevant print image Db are merged into a print image Direct voltage. The data so unified are buffered as a resulting print image D in a memory 4. At a given time these data are transmitted to the print device 6 as activation data As. The printing process is ended with the execution of all print commands per print medium B.

Naturally a free spraying can be omitted when all nozzles are used sufficiently often per print medium. Then only the data for the relevant print image Dr serve as activation data for the print device.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for free spraying of nozzles of a stationary inkjet printhead, with print media being directed past the stationary printhead, said method comprising the steps of:

with regard to a current information-conveying print image to be printed on at least one of said print media using nozzles of said inkjet printhead, identifying at least nozzles that are not participating in the printing of said current information-conveying print image; and free spraying at least some of said nozzles that are not participating in the printing of said current information-conveying print image onto one of said print media on which said current information-conveying print image is being printed, in a mode that is irrelevant for evaluation of said information-conveying print image, with said one of said print media, while said one of said print media is in a print position relative to said stationary inkjet printhead for printing said information-conveying print image.

2. A method as claimed in claim 1 comprising free spraying said at least some of said nozzles in a region on said one of said print media that is irrelevant for evaluation of said information-conveying print image.

3. A method as claimed in claim 1 wherein said information-conveying print image is comprised of pixels and is evaluated at a scale of said pixels, and wherein said method comprises:

generating a print pattern of dots resulting from said free spraying that cannot be evaluated at said pixel scale;

compiling an image-irrelevant print image from said print pattern; and combining said image-irrelevant print image with said information-conveying print image, to form a resulting image, and printing said resulting image on said one of said print media with said inkjet printhead.

4. A method as claimed in claim 3 wherein said information-conveying image contains white pixels and black pixels, and generating said print pattern to allow superimposition of said image-irrelevant print image on both said white pixels and said black pixels of said information-conveying print image.

5. A method as claimed in claim 3 wherein each pixel of said information-conveying print image is comprised of print dots having a characteristic selected from the group consisting of dot size and number of dots per pixel, and comprising generating said print pattern for said image-irrelevant print image to consist of dots having a characteristic that corresponds to and is significantly smaller than said characteristic of said dots of said pixels of said information-conveying print image.

6. A method as claimed in claim 1 wherein the step of free spraying said some of said nozzles in said image-irrelevant print image comprises free spraying said some of said nozzles at least once before or after printing said information-conveying print image.

7. A method as claimed in claim 1 comprising, prior to printing said information-conveying print image, producing a resulting print image compilation that is a combination of nozzles to be activated for printing said information-conveying print image and said some of said nozzles to be free-sprayed.

8. A method as claimed in claim 7 comprising free spraying said some of said nozzles in a region on said one of said print media that is irrelevant for evaluating said information-conveying print image, and wherein said some of said nozzles include unused nozzles, that are not used for printing said information-conveying print image, and infrequently used nozzles, that are infrequently used to print said information-conveying print image, and comprising free spraying said unused nozzles at least as often as said infrequently used nozzles.

9. A method as claimed in claim 7 comprising free spraying said some of said nozzles on a region of said one of said print media that is irrelevant for evaluating said information-conveying print image, and wherein said information-conveying print image comprises most frequently used nozzles that are most frequently used for printing said information-conveying print image, and comprising free spraying said some of said nozzles at least as often as said most frequently used nozzles.

* * * * *